US006295991B1

(12) United States Patent
Emery

(10) Patent No.: US 6,295,991 B1
(45) Date of Patent: Oct. 2, 2001

(54) LIGHTER HOLDER AND CIGAR NIPPER

(76) Inventor: William M. Emery, 5335 S. Fulton Lucas County Rd., Swanton, OH (US) 43558

( * ) Notice: Subject to any disclaimer, the term of this patent is extended or adjusted under 35 U.S.C. 154(b) by 0 days.

(21) Appl. No.: 09/450,405

(22) Filed: Nov. 29, 1999

(51) Int. Cl.[7] ..... A24F 15/08; A24F 13/24

(52) U.S. Cl. ..... 131/250; 131/248; 131/249; 30/109; 30/111; 30/112; 30/241; 30/249; 27/195

(58) Field of Search ..... 30/92, 112, 109, 30/110, 111, 113, 249, 241; D27/195; 431/253; 131/251, 248, 249, 250, 252

(56) References Cited

U.S. PATENT DOCUMENTS

| | | | | |
|---|---|---|---|---|
| D. 313,085 | | 12/1990 | Eisenbraun . | |
| D. 321,569 | | 11/1991 | Wallace . | |
| D. 377,845 | | 2/1997 | Maruyama . | |
| D. 387,474 | | 12/1997 | Fontaine, Jr. . | |
| 907,709 | * | 12/1908 | Adler . | |
| 1,294,358 | * | 2/1919 | Henriot . | |
| 4,553,926 | * | 11/1985 | Crespy | 431/253 |
| 4,837,931 | * | 6/1989 | Beerman | 30/92 |
| 5,409,374 | | 4/1995 | Liard . | |
| 5,738,117 | | 4/1998 | Fontaine, Jr. . | |
| 5,911,573 | * | 6/1999 | Tsai | 431/253 |
| 5,913,676 | * | 6/1999 | Kim | 431/253 |
| 6,151,781 | * | 11/2000 | Dehler | 30/111 |

* cited by examiner

*Primary Examiner*—James Derrington
*Assistant Examiner*—Carlos Lopez
(74) *Attorney, Agent, or Firm*—Emch, Schaffer, Schaub & Porcello, Co., L.P.A.

(57) ABSTRACT

A cigar cutter and lighter storage device for cutting off an end of a cigar is disclosed. The device has a tubular body with a first end for receiving a disposable lighter and a collar which removably secures the lighter within the body. A cutter element is secured in a second end of the tubular body. The cutter element has first and second opposed side elements and a cutting member, or knife, pivotally engaged between the first and second side members. The first and second side members define an opening for receiving the end of the cigar. The cutting member is pivotally rotated from a first, or open, position to a second, or closed, position in an arcuate manner through the opening, whereby the end of the cigar is cut.

10 Claims, 2 Drawing Sheets

FIG 3
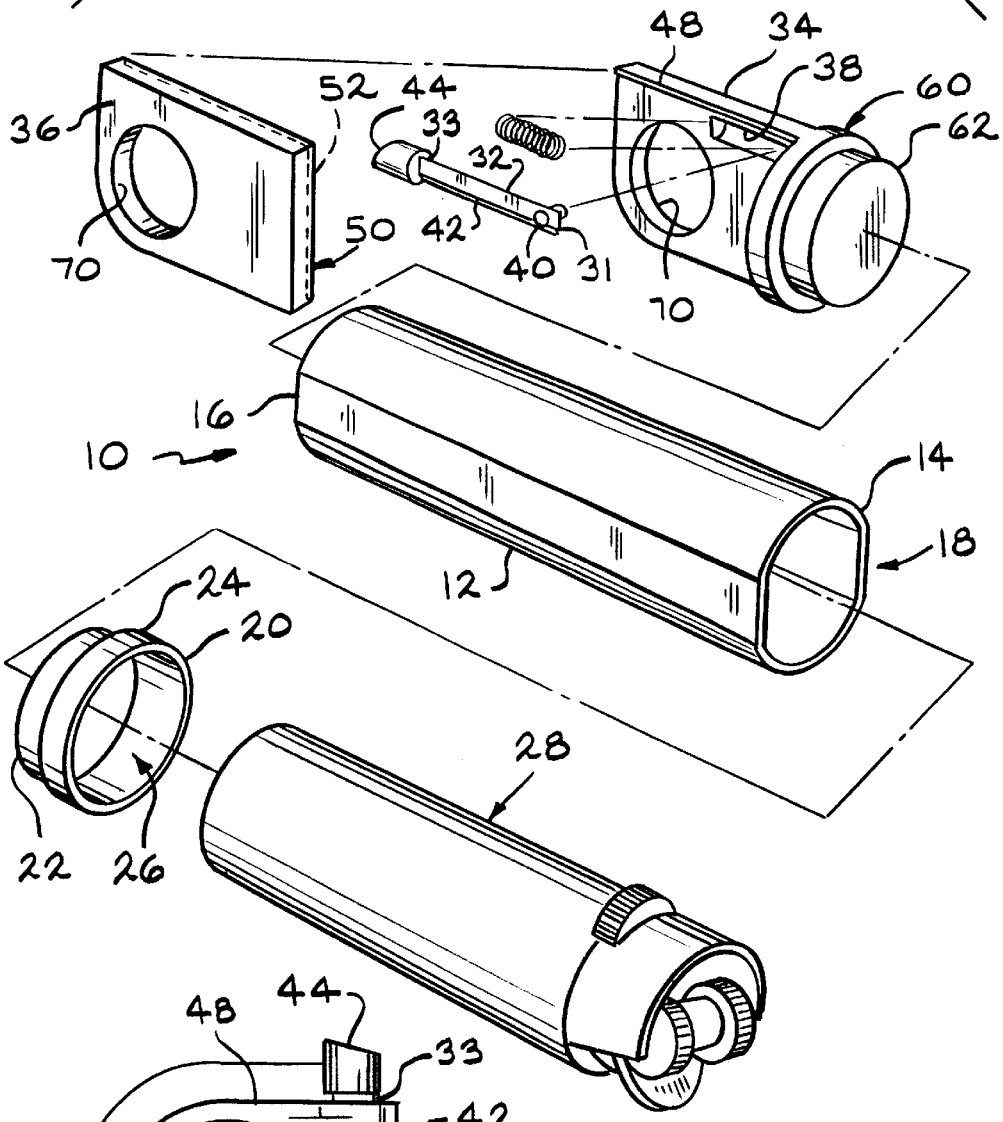
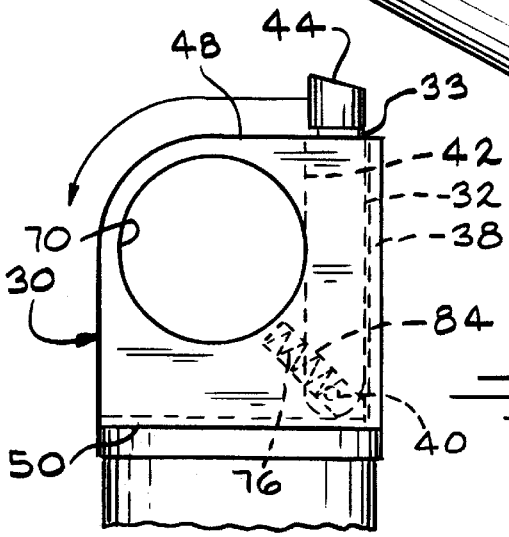
FIG. 4

LIGHTER HOLDER AND CIGAR NIPPER

TECHNICAL FIELD

The present invention relates generally to a combination cigar cutter and disposable lighter holder.

BACKGROUND OF THE INVENTION

Many cigars have an enclosed or top end which is placed in the smoker's mouth. The cigar has an open or bottom end which is lighted by the smoker. When a cigar is to be smoked, the top or mouth portion is trimmed or cut. By cutting the top end of the cigar, the smoker can inhale and circulate or pull air through the entire cigar. Thereafter, the bottom end of the cigar is lit and the smoke inhales. The Fontaine, Jr., U.S. Pat. No. 5,738,117 and U.S. Pat. No. Des. 387,474, describe a combination cigar lighter and cutter where the lighter is an integral part of the device. The Fontaine, Jr. devices cannot accept a disposable lighter. The Maruyama, U.S. Pat. No. Des. 377,845, also shows a combination cigar lighter and cutter where the lighter is integrally made as a part of the device.

It would be an advantage to have a device which is useful for cutting or trimming the top of the cigar and also which enables the smoker to readily have available a device for lighting the cigar.

SUMMARY OF THE INVENTION

The present invention is directed to a combination of cigar cutter with a storage receptacle for receiving a disposable lighter. The device comprises a tubular body having a cutter device at one end and a means for securing a disposable lighter in the opposing end. The cutter device has a pivotable knife or cutting element and a means for securing the top of the cigar while the cigar is being cut or trimmed.

It is an object of the present invention to provide a cigarette cutter having a storage receptacle for a disposable lighter.

It is a further object of the present invention to provide one convenient device for use to both cut a cigar and light the cigar.

It is a further object of the present invention to provide a cutter/lighter device which is inexpensive and easy to manufacture.

It is a further object of the present invention to provide a cutter/lighter device which can be used with different types of disposable lighters.

Other objects, features and advantages of the present invention will become apparent as the description below is considered in connection with the accompanying drawings.

DESCRIPTION OF THE DRAWINGS

FIG. 3 is an exploded view of the cutter/lighter storage device and a disposable lighter.

FIG. 4 is a side elevational view showing another embodiment of a cutter showing a compression spring in a 45° position.

DETAILED DESCRIPTION OF THE PREFERRED EMBODIMENT(S)

Figure 1:
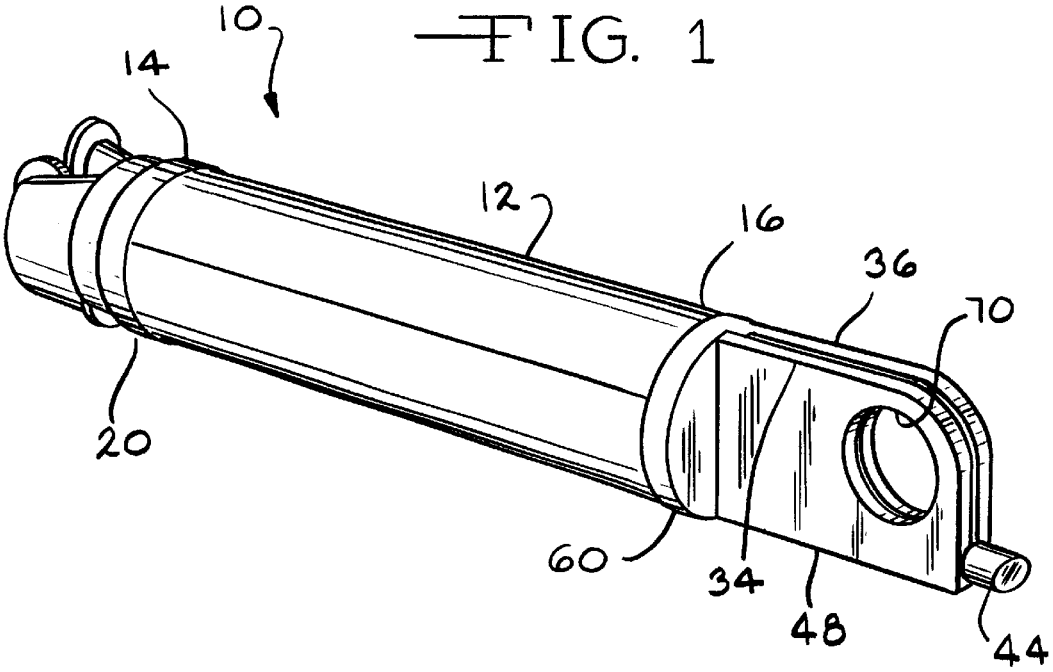
FIG. 1 is a perspective view of a cigar cutter/lighter storage device.
Figure 2:
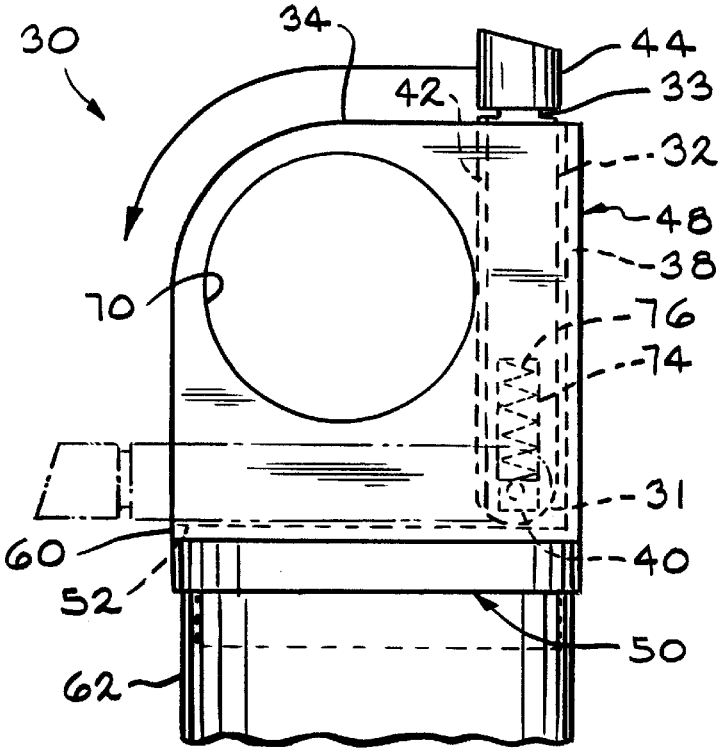
FIG. 2 is a side elevational view, partially in phantom, of one portion of the cutter device showing a compression spring in one position.

FIG. 1 is a perspective view of a cigar cutter/lighter storage device 10 of the present invention. The device 10 can have any desired predetermined geometric configuration. In the embodiment shown, the device 10 has a generally elliptical shape in order to receive commercial disposable lighters such as BIC® type disposable lighters. However, it is within the contemplated scope of the present invention that the device 10 can have other geometric configurations to accept other types of commercial disposable lighters. For ease of illustration a generally elliptical device 10 is shown.

The device 10 includes a tubular body 12. The body 12 can be made of any suitable material including metal or ABS type plastic material. It is contemplated that the body 12 can be made in any color and that printed material can be placed on the outer surface of the body 12. The body 12 has a first end 14 and an opposed second end 16. The body 12 defines at least one axially extending opening 18.

A securing collar 20 can be removably positioned in the first end 14 of the body 12. The securing collar 20 generally has a neck portion 22 and a collar 24. The neck 22 of the collar 20 generally defines a circumference which is compatible with the interior circumference of the first end 14. The collar 20 generally has the same shape, for example circular or elliptical or the like, as the body 12. The collar 20 defines an axially extending opening 26. The collar 20 is placed over the lighter 28 such that the neck 22 has a snug or interference fit with the interior diameter of a first end 14. A lighter 28 is slidably placed into the axially extending opening 26 in the collar 20. The shoulder 24 of the collar 20 secures the lighter 28 within the body 12. It is to be understood that the opening 26 of the collar 20 can have any desired shape to conform to the cross-sectional shape of the lighter 28.

The cutter/lighter device 10 further includes a cutter element 30 which has a knife cutting member 32 having a first end 31 and a second end 33. The cutting element 32 is secured between opposing side members 34 and 36. The first side member 34 has a recess or divot 38 for receiving a pivot pin 40. The pivot pin 40 is operatively attached to the first end 31 to the cutting element 32. The cutting member 32 has a sharp edge 42. The first and second side members 34 and 36 are in an opposed, yet adjacent relationship such that the cutting member 32 is freely movable between the first side member 34 and the second side member 36. A thumb lever 44 is secured to the second end 33 of the cutting member 32.

In a stored position, the cutting member 32 is held adjacent a first edge 48 defined by the first and second side members 34 and 36. The first edge 48 has a suitable width such that the cutting element 32 is not exposed when the cutting element 32 is in an open position.

The side members 34 and 36 also define a second edge 50 which generally forms a right angle to the first edge 48. The second edge 50 also has a suitable width such that the cutting element 32 is not exposed when the cutting element is in a closed position.

At least one of the side members 34 and 36 defines a glue channel 52 on an interior surface thereof. The glue channel 52 runs substantially parallel to the second edge 50. A suitable amount of glue is received in the glue channel 52 to secure the side members 34 and 36 together. At least one of the side members 34 and 36 further includes a radially extending base 60 which has substantially the same geometric shape and dimensions as the circumference of the second end 16 of the body 12. The side member 36 further defines a neck 62 which generally has the same geometric shape and internal diameter as the second end 16 of the body 12. Preferably, the cutter 30 is secured in a nonremovable manner to the second end 16 by applying a suitable amount of an adhesive or glue material to at least the neck 62 to secure the cutter 30 within the second end 16 of the body 12.

The side members 34 and 36 further define an opening 70 which generally extends through the side members 34 and 36 at an angle perpendicular to an axis extending through the body 12. The opening 70 has a suitably large circumference for receiving a top of a cigar.

As another feature, the cutter/lighter device 10 can have at least one of side members 34 or 36 which defines an internal channel 74. The channel 74 can be substantially parallel to the first edge 48 of the side members 34 and 36. A compression mechanism 76 such as, for example a spring, is positioned in the channel 74 for biasing the cutting element 32 in an open position. As the cutting member 32 is rotated from a first, or open, position adjacent the edge 48 to a second, or closed, position, adjacent the second edge 50, the cutting member 32 is rotated through a 90° are from the first edge 48 to the second edge 50. The compression member 76 exerts a force against the pivot point 40 as the cutting member 32 is rotated through the cigar opening 70. It is also within the contemplated scope of the present invention that the cutter/lighter device 10 can alternatively have an internal channel 84 which is at a substantially 45° angle with respect to the first edge 48 and the second edge 50.

The above detailed description of the present invention is given for explanatory purposes. It will become apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A cigar cutter and lighter storage device for cutting off the end of a cigar, the device comprising a tubular body having a first end for receiving a disposable lighter;

a collar removably secured in the first end of the body for removably securing the lighter within the body;

a cutter element secured in a second end of the tubular body; the cutter element comprising first and second opposed side members and a cutting member pivotally engaged between the first and second side members, the first and second side members defining an opening for receiving the end of the cigar;

the cutting member being pivotally rotatable from a first position to a second position in an arcuate manner through the opening whereby the end of the cigar is cut.

2. The claim of claim 1, wherein at least one side member has a radially extending base which matingly engages the second end of the tubular body.

3. The device of claim 2, wherein the base further defines an axially extending collar for securing the cutter element within the second end of the tubular body.

4. The claim of claim 1, wherein at least one side member defines a channel for receiving an adhesive material whereby the first and second side members secured in a spaced apart relationship for allowing the cutting member to pivotally rotate between the first and second side members.

5. The device of claim 1, wherein the cutting member is secured to at least one side member by a pivot member.

6. The device of claim 1, wherein a compression member is secured between the pivot member and a first end of the cutting member.

7. The device of claim 6, wherein the compression member is secured within a channel adjacent a first end defined by the first and second side members.

8. The device of claim 6, wherein the compression member is secured within a channel that is at a substantially 45° angle between the first edge defined by the first and second side members and a second edge defined by the first and second side members.

9. The device of claim 1, wherein the collar comprises a neck having substantially a same or slightly smaller circumference than an internal circumference of the first end of the tubular body, the neck being connected to a shoulder which has a diameter or circumference greater than the neck, the shoulder removably securing the lighter within the tubular body.

10. The device of claim 1, wherein the tubular body has a predetermined geometric configuration.

* * * * *